US008759266B2

(12) United States Patent
Wardlow et al.

(10) Patent No.: US 8,759,266 B2
(45) Date of Patent: Jun. 24, 2014

(54) LUBRICANT COMPOSITION WITH IMPROVED ELECTRICAL PROPERTIES

(75) Inventors: Andrea B. Wardlow, Cherry Hill, NJ (US); Marc-Andre Poirier, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1536 days.

(21) Appl. No.: 11/725,774

(22) Filed: Mar. 20, 2007

(65) Prior Publication Data

US 2008/0234155 A1 Sep. 25, 2008

(51) Int. Cl.
*C10M 135/10* (2006.01)

(52) U.S. Cl.
USPC ..... 508/568; 508/485

(58) Field of Classification Search
USPC ..... 508/485, 568
See application file for complete search history.

(56) References Cited

U.S. PATENT DOCUMENTS

| | | | | |
|---|---|---|---|---|
| 5,744,431 | A * | 4/1998 | Diaz et al. | 508/410 |
| 5,940,246 | A | 8/1999 | Khan et al. | |
| 6,335,310 | B1 | 1/2002 | Suekuni et al. | |
| 6,645,920 | B1 | 11/2003 | Butke | |
| 2005/0183325 | A1 * | 8/2005 | Sutkowski | 44/418 |
| 2006/0217273 | A1 * | 9/2006 | Ozbalik et al. | 508/269 |
| 2008/0287717 | A1 * | 11/2008 | Kuechler et al. | 585/14 |

FOREIGN PATENT DOCUMENTS

| | | | |
|---|---|---|---|
| EP | 1 609 844 | A1 | 12/2005 |
| WO | WO 2008/006876 | A1 | 1/2008 |

* cited by examiner

*Primary Examiner* — Jim Goloboy
(74) *Attorney, Agent, or Firm* — Robert A. Migliorini; Liza Montalvo

(57) ABSTRACT

A lubricant composition for improving electrical properties in lubricant systems to reduce the formation of sludge and varnish is disclosed. The lubricant composition comprises a base oil and an effective amount of antistatic additive to provide the composition with an electrical conductivity of at least about 50 pS/m at 25° C. and a dielectric strength of at least 300 V/mil.

3 Claims, 1 Drawing Sheet

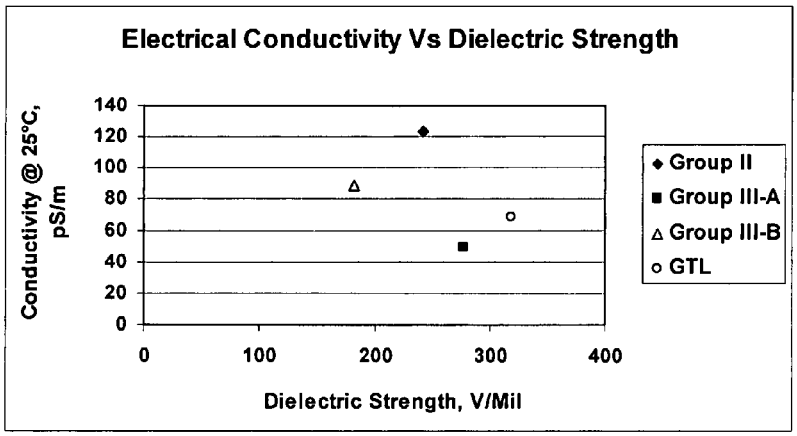
Electrical Conductivity Vs Dielectric Strength
Conductivity @ 25°C, pS/m
140
120
100
80
60
40
20
0
0
100
200
300
400
Dielectric Strength, V/Mil
Group II
Group III-A
Group III-B
GTL

LUBRICANT COMPOSITION WITH IMPROVED ELECTRICAL PROPERTIES

FIELD OF THE INVENTION

This invention relates to lubricant compositions. More particularly, this invention relates to lubricant compositions having improved electrical properties specifically, improved electrical conductivity and dielectric strength.

BACKGROUND OF THE INVENTION

Failures in industrial oil systems have been associated with sludge and varnish formation. Sludge and varnish are insoluble materials formed as a result of either degradation reactions in the oil, contamination of oil or both. Explanations for the formation of sludge and varnish in these systems have varied but typically include the nature of the base oil, additive instability or degradation, bulk oil oxidation, electrostatic discharge and low electrical conductivity.

Much attention has been directed to the potential role of fluid electrification and electrostatic discharge as a prominent contributor to sludge and varnish formation in industrial oil systems. Electrostatic discharge is a form of localized thermal degradation. Electrostatic charge generation occurs in fluids systems as a result of internal molecular friction and electrical potential between the fluid and machine surfaces. The magnitude of the electrostatic charge within the oil depends on many factors and grounding of the machine itself has little impact toward mitigating electrostatic charge propagation. This is because the oils used are nonconductive and effectively self-insulate the charged fluid zones from grounded surfaces. Once a charge builds up in a working fluid zone, the subsequent static discharge may cause localized thermal oxidative oil degradation.

In the prior art, many antistatic additives have been suggested and used. U.S. Pat. No. 6,645,920 is directed to a lubricating oil composition for inhibiting rust and/or oxidation without formation of filter plugging deposits and sludge caused by acidic rust inhibitors in lubricating oil. The composition comprises an oxidation package, a rust inhibitor, a metal deactivator, an oil of lubricating viscosity and optionally other additives. The acidic rust inhibitor may be hydrocarbyl amine salts of hydrocarbyl aryl sulphonic acid. The oil of the invention may be natural or synthetic lubricating oils such as mineral, vegetable and animal oils and polymerized olefins, liquid esters and Fischer-Tropsch hydrocarbons.

U.S. Pat. No. 5,744,431 is directed to a lubricant composition used to prevent electrostatic charge build-up during operations of magnetic disk drives in computer system. One of the antistatic additives disclosed is STADIS 450, which was previously used as an antistatic additive in aviation fuels. The lubricating grease of the disclosed invention consists of light oil and a thickener, where the light oil consists of mineral oil, polyalphaolefins, diesters or aliphatic esters of polyol.

U.S. Pat. No. 5,940,246 is directed to a hydrobearing fluid for use in hydrodynamic bearing spindle motors for disc drive data storage devices. The hydrobearing fluid comprises an electrically non-conductive lubricant and an electrically conductive, non-metallic, non-magnetic additive. Lubricant base oils include mineral based hydrocarbons, synthetic hydrocarbons or esters. Additives include commercially available organic polymers such as a solution of a solvent (toluene, isopropyl alcohol, and other aromatic solvents $C_9$-$C_{16}$), dodecyl, benzene and sulfonic acid.

U.S. Pat. No. 6,335,310 is directed to a conductive lubricant for a fluid dynamic bearing to be assembled into a hard disk drive. The conductive lubricant comprises an ester based oil and an antistatic additive. The antistatic additive may be an alkyl aryl sulfonate, which is a salt of neutralization of alkyl benzene sulfonate and alkylamine.

Despite the advances in lubricant oil formulation technology, there remains a need for antistatic additives that effectively improve the electrical conductivity in lubricant compositions while maintaining the compositions dielectric strength and thereby reducing the formation of sludge and varnish in oil based lubricants.

It has been found that oil based lubricants having an electrical conductivity of at least 50 pS/m at 25° C. and a dielectric strength of at least 300 V/mil would significantly reduce electrostatic discharge in industrial oil systems thereby reducing the formation of sludge and varnish.

SUMMARY OF THE INVENTION

The present invention relates to a lubricant composition for industrial oil applications having improved electrical properties. The lubricant composition has an electrical conductivity of at least 50 pS/m at 25° C. and a dielectric strength of at least 300 V/mil. When formulated with an antistatic additive and GTL base oil, the lubricant composition exhibits excellent electrical conductivity while maintaining its dielectric strength thereby reducing formation of sludge and varnish in lubricant systems.

In accordance with a first aspect of the invention, there is provided a lubricant composition containing the antistatic additive of the present invention.

In another aspect of the invention, there is provided a method of improving the electrical properties of a lubricant composition by using the antistatic additive of the present invention.

Other objects and advantages of the present invention will become apparent from the detailed description that follows.

BRIEF DESCRIPTION OF THE DRAWINGS

FIG. 1 shows the dielectric strength verses the electrical conductivity of Group II, Group III and GTL base oils.

DETAILED DESCRIPTION

The present invention relates to a lubricant composition useful for improving electrical properties in lubricant systems comprising a GTL base oil and an effective amount of a non metallic antistatic additive.

By GTL base oil it is meant a base oil produced from base stock(s) obtained from a gas to liquid (GTL) process via one or more synthesis, combination, transformation, rearrangement, and/or degradation deconstructive process from gaseous carbon containing compounds. Preferably, the GTL base stock(s) is derived from the Fischer-Trospch (FT) synthesis process wherein a synthesis gas comprising a mixture of $H_2$ and CO is catalytically converted to lower boiling materials by hydroisomerisation and/or dewaxing. The process is described, for example, in U.S. Pat. Nos. 5,348,982 and 5,545,674, and suitable catalysts in U.S. Pat. No. 4,568,663, each of which is incorporated herein by reference.

GTL base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/S$. The GTL base stock and/or other hydrodewaxed, or hydroisomerized/cat (or solvent) dewaxed wax derived base stock(s) used typically in the present invention have kinematic viscosities in the range of about 3.5 $mm^2/s$ to 7 $mm^2/s$, preferably about 4 $mm^2/s$ to about 7 $mm^2/s$, more preferably about 4.5 $mm^2/s$ to 6.5 $mm^2/s$ at 100° C. Reference herein to kinematic viscosity refers to a measurement made by ASTM method D445.

GTL base stock(s) which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. In the present invention, however, the GTL base stock(s) used generally are those having pour points of about −30° C. or higher, preferably about −25° C. or higher, more preferably about −20° C. or higher. References herein to pour point refer to measurement made by ASTM D97 and similar automated versions.

The GTL base stock(s) derived from GTL materials, especially hydrodewaxed or hydroisomerized/cat (or solvent) dewaxed synthetic wax, especially F-T material derived base stock(s) are also characterized typically as having viscosity indices of 80 or greater, preferably 100 or greater, and more preferably 120 or greater. Additionally, in certain particular instances, the viscosity index of these base stocks may be preferably 130 or greater, more preferably 135 or greater, and even more preferably 140 or greater. For example, GTL base stock(s) that derive from GTL materials, preferably F-T materials, especially F-T wax, generally have a viscosity index of 130 or greater. References herein to viscosity index refer to ASTM method D2270. GTL base stock(s) having a kinematic viscosity of at least about 3 $mm^2/s$ at 100° C. and a viscosity index of at least about 130 provide good results.

In addition, the GTL base stock(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock(s) obtained by the hydroisomerization/isodewaxing of F-T material is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins based on total GTL base stock composition.

Useful compositions of GTL base stock(s) are recited in U.S. Pat. Nos. 6,080,301; 6,090,989, and 6,165,949 for example.

Other base stock(s) that may be used in this invention, are paraffinic fluids of lubricating viscosity derived from hydrodewaxed, or hydroisomerized/cat (or solvent) dewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stocks and base oils.

A preferred GTL base stock is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geq 4$), are such that: (a) $BI-0.5(CH_2 \geq 4)>15$; and (b) $BI+0.85\ (CH_2 \geq 4)<45$ as measured over said base stock.

The preferred GTL base stock can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geq 25.4$ and $(CH_2 \geq 4) \leq 22.5$. They have a boiling point of about 370° $C.^+$, on average they average fewer than 10 hexyl or longer branches per 100 carbon atoms and on average have more than 16 methyl branches per 100 carbon atoms. They also can be characterized by a combination of dynamic viscosity (DV), as measured by CCS at −40° C., and kinematic viscosity (KV), as measured at 100° C. represented by the formula: DV (at −40° C.)<2900 (KV at 100° C.)−7000.

The preferred GTL base stock is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geq 4$), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geq 4$)

A 90.5 $MHz^3CMR$ single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a. calculate the average carbon number of the molecules in the sample which is accomplished with sufficient accuracy for lubricating oil materials by simply dividing the molecular weight of the sample oil by 14 (the formula weight of $CH_2$);
b. divide the total carbon-13 integral area (chart divisions or area counts) by the average carbon number from step a. to obtain the integral area per carbon in the sample;
c. measure the area between 29.9 ppm and 29.6 ppm in the sample; and
d. divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

GTL base stock(s) are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stocks.

Low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

Antistatic additives of the present invention include non-metallic antistatic additives. Preferably, the non-metallic antistatic additives are aryl sulfonic acids, more preferably alkyl aryl sulfonic acids. Even more preferably, the alkyl aryl sulfonic acid is a dinonyl napthyl sulfonic acid (DINNSA). DINNSA is commercially available under the trade name STADIS® 450. Other suitable alkyl aryl sulfonic acids include STADIS® 425.

Formulated lubricant compositions comprise a mixture of at least one base stock and/or base oil and at least one performance additive. Usually, the base stock is a single oil secured from a single crude source and subjected to a single processing scheme and meeting a particular specification. Base oils comprise at least one base stock.

The lubricant composition of the present invention comprises a base oil, preferably a GTL base stock, and an effective amount of an antistatic additive. By effective amount, it is meant that the antistatic additive is present in amounts ranging from about 5 μl/L to about 50 μl/L, preferably from about 10 μl/L to about 20 μl/L, of the total lubricant composition. An effective amount of antistatic additive provides the lubricant composition with an electrical conductivity of at least about 50 pS/m at 25° C. and a dielectric strength of at least 300 V/mil. The base oil constitutes the major amount of the lubricant composition and typically is present in an amount ranging from about 50 to about 99 wt. %, e.g., from about 85 to about 95 wt. %, based on the total weight of the composition.

The lubricating composition of the present invention may be formulated with one or more additional additives such as antioxidants, pour point depressants, rust inhibitors, metal deactivators, VI improvers, extreme pressure additives, demulsifiers, dispersants, solubilizers and antifoamants.

Among suitable antioxidants are hindered phenols and alkylated diphenyl amines. Suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. Alkyl succinimides may be used as antitrust additives. Benzotriazole derivatives are useful in the lubricant composition as metal deactivators. Suitable viscosity index improvers include olefin polymers, polyalkyl(meth) acrylates, vinyl aromatic-diene copolymers and mixtures thereof. Various types of sulfur-containing and phosphorus-containing antiwear and/or extreme pressure agents used can be dihydrocarbyl polysulfides, sulfurized olefins and sulfurized fatty acid esters; oil-soluble organic phosphates, organic phosphites, organic phosphonates and organic phosphonites. Suitable demulsifiers include derivatives of propylene oxide, ethylene oxide, alkyl amines and amino alcohols. Alkenylsuccinic derivatives and hydrocarbyl-substituted succinic acid compounds may be used as dispersants. Suitable solubilizers include alkylated aromatics such as alkylated benzenes, alkylated toluenes, alkylated naphthylenes, alkylated biphenyls and alkylated diphenyl methane. The antifoamant used typically will be a silicone oil antifoamant.

The foregoing additives are all commercially available materials. Indeed, these additives are usually not added independently but are precombined in packages which can be obtained from suppliers of lubricant oil additives. Additive packages with a variety of ingredients, proportions and characteristics are available and selection of the appropriate package will take the requisite use of the ultimate composition into account.

In preparing the lubricant compositions, the antistatic additive composition of the present invention, other additives or mixtures thereof are added to a base stock and/or base oil and are mixed to make up a substantially homogeneous mixture.

The following non-limiting examples are provided to illustrate the invention.

EXAMPLE 1

A series of lubricant compositions were formulated and evaluated for their electrical conductivity and dielectric strength.

The lubricant compositions were formulated using as the base oil one of a Group II base oil, a Group IIIA base oil, a Group IIIB base oil and a GTL base oil. The Group II base oil had a viscosity index of between about 80 to 120, a kinematic viscosity at 100° C. of about 6 $mm^2/s$ and contained less than or equal to about 0.03% sulfur and greater than or equal to about 90% saturates. The Group IIIA base oil was a VISOM™ base oil having a kinematic viscosity at 100° C. of about 6 $mm^2/s$. The Group IIIB basestock oil was a YUBASE™ base oil having a kinematic viscosity at 100° C. of about 6 $mm^2/S$. The GTL base oil had a kinematic viscosity of about 6 $mm^2/s$ at 100° C. and a viscosity index greater than about 150.

The antistatic additive used was dinonyl napthyl sulfonic acid (DINNSA). The antistatic additive had a kinematic viscosity of about 6 $mm^2/s$ at 100° C. and a pour point of less than about −40° C. DINNSA is commercially available under the trademark Stadis® 450.

The electrical conductivity of the lubricant compositions was measured at 25° C. according to the ASTM D4308, which is incorporated herein by reference. The electrical conductivity was measured in duplicate. The dielectric strength was measured on the blends containing 6 μl of DINNSA, according to the ASTM D877, which is incorporated herein by reference. Dielectric strength is the voltage at which breakdown occurs in the fluid. Dielectric strength measures the ability of a fluid to withstand electrical stress at power frequencies without failure. The reported dielectric strength results are the average of ten readings.

Table 1 shows that all base oils, without any additive, have very low electrical conductivity, about 2 pS/m. Adding 6 μl of Stadis® 450 to 300 gm of base oil was required to increase the electrical conductivity of all the base oils to >50 pS/m. As can be seen, only the GTL base oil achieved an electrical conductivity >50 pS/m while minimizing the loss in dielectric strength. The dielectric strength for the GTL base oil experienced only a 24% reduction as compared with a 36% reduction for a Group II and Group IIIA base oil and a 49% reduction for Group IIIB base oil. By improving the electrical conductivity of the base oil to at least about 50 pS/m at 25° C. and a dielectric strength of at least 300 V/mil, the antistatic additive will effectively reduce electrostatic discharge in the lubricant oil system thereby reducing the formation of sludge and varnish.

TABLE 1

| | Fluid 1 | Fluid 2 | Fluid 3 | Fluid 4 |
|---|---|---|---|---|
| | Base Oil | | | |
| | Group II | GTL | Group III-A | Group III-B |
| Base Oil, gm | 300 | 300 | 300 | 300 |
| Antistatic additive, μl | 0 | 0 | 0 | 0 |
| Conductivity, pS/m | 2 | 2 | 2 | 2 |
| Dielectric Strength, V/Mil | 379 | 421 | 435 | 357 |
| Antistatic additive, μl | 6 | 6 | 6 | 6 |
| Conductivity, pS/m | 123 | 68 | 50 | 88 |
| Dielectric Strength, V/Mil | 242 | 319 | 278 | 182 |
| Dielectric Strength Red. | −137 | −102 | −157 | −175 |
| % Reduction | 36.1 | 24.2 | 36.1 | 49.0 |

As can be seen by FIG. 1, there is no correlation between the electrical conductivity and the dielectric strength properties. Therefore, the dielectric strength is not predictable based on the electrical conductivity.

It will thus be seen that the objects set forth above, among those apparent in the preceding description, are efficiently attained and, since certain changes may be made in carrying out the present invention without departing from the spirit and scope of the invention, it is intended that all matter contained in the above description and shown in the accompanying drawing be interpreted as illustrative and not in a limiting sense.

It is also understood that the following claims are intended to cover all of the generic and specific features of the invention herein described and all statements of the scope of the invention, which as a matter of language, might be said to fall there between.

What is claimed is:

1. An industrial oil composition comprising: a base oil consisting essentially of a GTL oil; and a non-metallic antistatic additive to provide said lubricant composition with an electrical conductivity of at least about 50 pS/m at 25° C. and a dielectric strength of at least 300V/ml whereby said industrial oil composition has improved electrical properties as evidenced by said dielecric strength when compared to industrial oil compositions comprising a Group II or Group III base oil containing the same antistatic additive in the same amount of the claimed composition, wherein said base oil is about 99 wt % of the lubricant composition, wherein the non-metallic antistatic additive is dinonyl naphthyl sulfonic acid, and wherein said non-metallic antistatic additive is present in amount of about 6 μl/L and with the proviso that the composition is essentially free of dispersants.

2. A method for improving the electrical properties of an industrial oil composition comprising a base oil, said method comprising adding a non-metallic antistatic additive to an industrial oil composition comprising a base oil consisting essentially of a GTL base oil and mixing the additive and GTL base oil to make a substantially homogeneous mixture, said additive being added to said composition to provide said composition with an electrical conductivity of at least about 50 pS/m at 25° C. whereby the dielectric strength of the composition is at least 300V/ml which is greater than the dielectric strength of compositions prepared by the same method but with different base oils, wherein said base oil is about 99 wt. % of the composition, wherein the non-metallic antistatic additive is dinonyl naphthyl sulfonic acid, and wherein said non-metallic antistatic additive is present in amount of about 6 μl/L and with the proviso that the composition is essentially free of dispersants.

3. A method for reducing formation of sludge and varnish in industrial oil lubricant systems comprising using the composition of claim 1.

* * * * *